United States Patent [19]

Silberling

[11] Patent Number: 4,662,010

[45] Date of Patent: May 5, 1987

[54] FLOATER WATERBED

[76] Inventor: Peter W. Silberling, 72 Ketewemoke Dr., Halesite, N.Y. 11743

[21] Appl. No.: 877,210

[22] Filed: Jun. 23, 1986

[51] Int. Cl.[4] ..... A47C 27/08

[52] U.S. Cl. ..... 5/451; 5/1

[58] Field of Search ..... 5/451, 450, 422, 455, 5/449, 60, 1; 128/1 R, 1 B

[56] References Cited

U.S. PATENT DOCUMENTS

| | | | |
|---|---|---|---|
| 1,943,888 | 1/1934 | Ewald | 5/451 |
| 3,909,859 | 10/1975 | Harris | 5/451 |
| 4,000,749 | 1/1977 | Busco | 128/1 R |
| 4,079,728 | 3/1978 | Gatts | 128/1 B |
| 4,468,824 | 9/1984 | O'Hanlan | 5/451 |

*Primary Examiner*—Alexander Grosz

*Attorney, Agent, or Firm*—Jerome Bauer

[57] ABSTRACT

A waterproof vinyl body bag or sleeve open to the air at both ends which is inserted inside a main vinyl waterbed having two apertures, of the same dimensions as the open ends of the body bag, on its top surface. The bag or sleeve is sealed at the edges of both open ends permanently to the top surface of the waterbed at the edges of its two apertures, thus creating a suspended free floating sleeve inside a waterbed, into which a person can climb and lie prone while remaining dry, surrounded by the water in the bed.

1 Claim, 4 Drawing Figures

FLOATER WATERBED

CROSS REFERENCES TO RELATED APPLICATIONS

There are no related applications.

BRIEF SUMMARY OF THE INVENTION

This invention is based on the theory elaborated at the New York University of Stony Brook recently which states that the human body derives many benefits from immersion in water, including deep relaxation, removal of tensions causing stress and pain, and stabilization of blood pressure. Unfortunately, the body is not able to remain immersed in water for long periods because of damage to the skin, nor is it able to relax completely in the water to free the body from all tensions. My invention provides a means of remaining dry and relaxed, while surrounded by water, except for the head, which, as in floating, can remain open to the air. This is accomplished by a person climbing into a vinyl body bag, suspended in the water inside a waterbed, where he can stretch out, rest his head back on the waterbed surface and enjoy the sensation of free floating and complete relaxation surrounded by water, long known for its healing and soothing benefits. If desired, the person can sleep all night in the bag.

BRIEF DESCRIPTION OF THE DRAWINGS (Sheets 1; Figures 4)

There are four figures in the drawing upon one sheet.

FIG. 1 shows the top view of a waterbed, enclosed and supported on five sides (four sides and bottom) by a frame. There are two openings in the waterbed at which an interior vinyl body bag is attached and sealed at the time of manufacture, preferably. This bag is suspended and floats in the water inside the main waterbed.

FIG. 2 shows a side view of the waterbed on the left, which is a cutaway from the supporting wood frame, which in a normal side view would reach nearly to the top of the waterbed inside. Wishing to show you the waterbed, we have eliminated the wood frame which is shown in FIG. 1 on all sides of the waterbed proper. On the right side of FIG. 2 we show you a double cutaway view, which shows the body bag floating in the water inside the waterbed, attached at the foot. The bag is also attached at the other end, as shown by the dotted lines, on the left of the figure, to the main waterbed.

FIG. 3 is a drawing of the interior vinyl body bag or sleeve. The opening at the left (3) is wide and deep enough for a person to enter and exit from the bag easily, and it is from this aperture that his head will protrude when he is lying prone inside the bag. The opening (4) is for the feet to protrude, if desired, The bag can be manufactured in various sizes.

FIG. 4 is a double cutaway pictorial view to show you how a person would look resting inside the body sleeve which floats and is suspended inside the main waterbed.

DETAILED DESCRIPTION OF THE DRAWINGS

Figure 1:
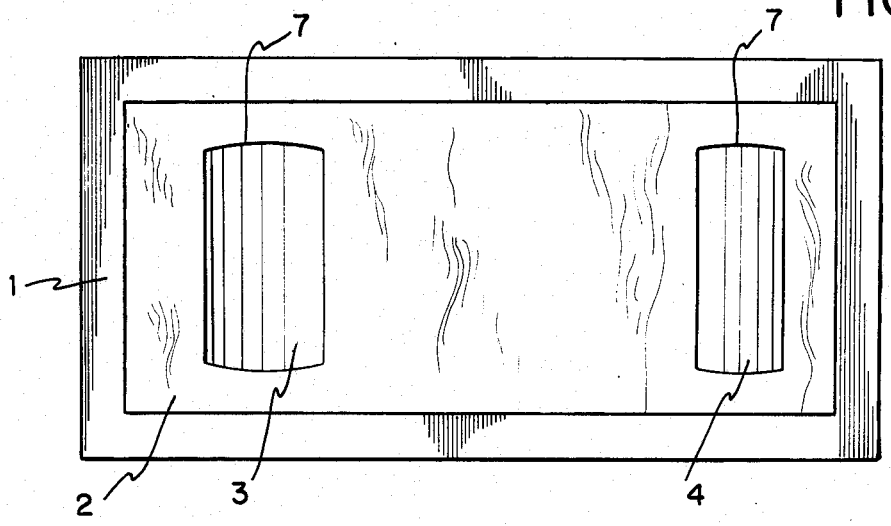

FIG. 1 is a top view of the vinyl Floater waterbed (2) in its wood frame (1) which is high enough and strong enough to support the waterbed on four sides and the bottom. This waterbed proper should be deep enough to float a human body inside it, probably at least 3 feet deep. The top surface differs from a conventional waterbed in that there are two apertures (3) and (4) around the edges of which is attached an interior floating body sleeve by means of waterproof seals (7), strong enough to withstand pressure and hold the weight of a human body. The wider aperture (3), which should be nearly three feet wide and nearly two feet deep, suggest the approximate dimensions of the interior body sleeve. At this opening (3) a person would enter and exit from the interior sleeve (5), and his head would protrude from this aperture. The slghtly smaller opening (4), approximately one and a half feet by three feet, is for the feet to protrude if desired, and for comfort and safety, as well as to secure the other end of the suspended interior body bag (5), which will be shown in the other figures on this sheet. This end of the body bag is secured by the same strong waterproof seals (7) used in securing the other end. The width of the waterbed should be about four feet. The length will vary with the size of the person to be using the bed and the size of the interior bag.

Figure 2:
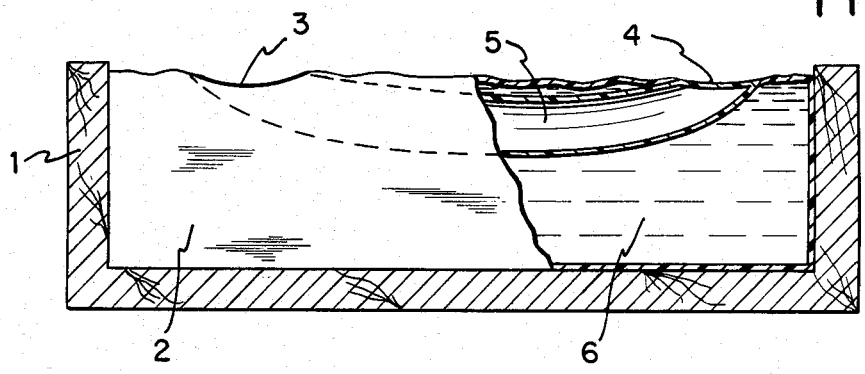

FIG. 2 shows a side view of the vinyl Floater waterbed (2) in its frame (1). The frame, probably wood, which supports the side of the waterbed proper has not been drawn in on this view, but has been omitted to show, on the left, the waterbed (2) and on the right, a cutaway view of the interior body sleeve (5), also vinyl and waterproof, floating in the water (6) and attached at the aperture (4) to the main waterbed (2) and (by dotted lines) on the left of the figure, attached at the aperture (3) to the main waterbed (2).

Figure 3:
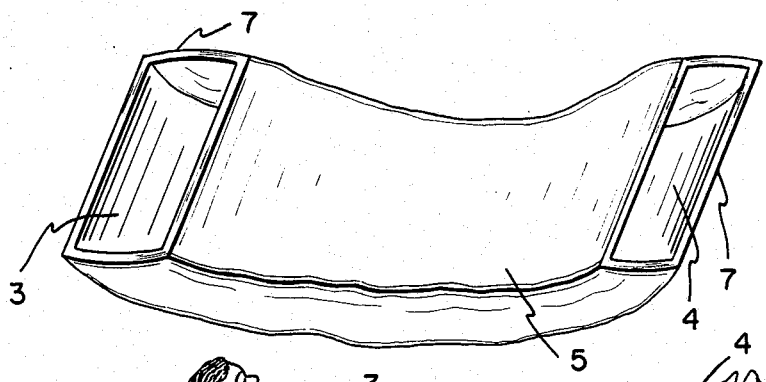

FIG. 3 is a perspective view of the interior body sleeve or bag (5) which is made of the same flexible vinyl material used in the main waterbed (2), or a slightly lighter weight vinyl for increased comfort and flexibility. The openings (3) and (4) are shown at either end of the bag (5), surrounded by the strong waterproof edges (7) to be sealed to the edges of the openings on the top of the main waterbed (2). The same sealing process as is presently in use for seams on conventional waterbeds should be sufficient to render them waterproof, but if in the view of the manufacturer an additional reinforcement is needed for these seams to withstand the pressure of repeated entry and egress from the interior bag (5) than an additional piece of heavy vinyl can be sealed around these edges (7). This bag can be manufactured in a number of sizes, such as small, medium and large adult and also childrens' sizes. It should have sufficient length for the person using it to allow him to move comfortably within the bag and float freely in the water (6) inside the waterbed (2). If it is too short for an individual, he will be suspended only and will not experience the beneficial effect of a free floating sensation. The average width and depth of the sleeve (5) for an adult would be about three feet wide and two feet deep, which must be the same dimensions as the aperture (3). The other end of the bag or the foot may be somewhat smaller in width and depth, such as three feet wide and one and one half feet deep, but the dimensions of the opening of the bag at the foot must correspond exactly with the dimensions of the aperture (4) so that they may be sealed together at their respective edges at (7). The person should be able to enter and exit with ease from the sleeve, and while inside, move around a little.

Figure 4:
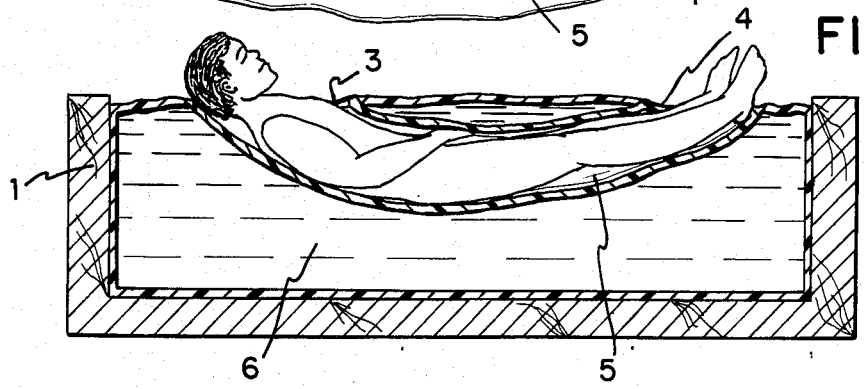

FIG. 4 is a pictorial view of a person lying in repose within the body sleeve (5), floating in the water (6) within the main water bed (2). In this figure both the side frame and the surface side of the waterbed proper (2) have been omitted to show how a person looks lying prone in the bag (5) with his head resting back on the top surface of the main waterbed (2) while it protrudes from the aperture (3). His feet are open to the air at aperture (4). A person may also use this waterbed in the conventional way, lying on top of it without getting into the bag, if he wishes.

I claim:

1. A vinyl waterbed, supported by a frame on four sides and the bottom, comprising two openings on its top surface at which openings an interior waterproof body sleeve or bag is inserted and permanently sealed around the edges of the bag openings to the edges of the waterbed openings, and becomes suspended and floating in the water inside this main waterbed whereby at the larger of the two openings in the top of the waterbed, a person may climb into the body sleeve and lie down, floating in the water but remaining dry inside the bag.

* * * * *